US008668603B2

(12) United States Patent
Hammons

(10) Patent No.: US 8,668,603 B2
(45) Date of Patent: Mar. 11, 2014

(54) LIGHTWEIGHT TUNNEL FOR BASEBALL PITCHING PRACTICE

(71) Applicant: Matthew Hammons, Scottsdale, AZ (US)

(72) Inventor: Matthew Hammons, Scottsdale, AZ (US)

( * ) Notice: Subject to any disclaimer, the term of this patent is extended or adjusted under 35 U.S.C. 154(b) by 0 days.

(21) Appl. No.: 13/711,053

(22) Filed: Dec. 11, 2012

(65) Prior Publication Data

US 2013/0102423 A1 Apr. 25, 2013

Related U.S. Application Data

(63) Continuation of application No. PCT/US2011/001199, filed on Jul. 7, 2011.

(60) Provisional application No. 61/362,047, filed on Jul. 7, 2010.

(51) Int. Cl.
*A63B 69/00* (2006.01)

(52) U.S. Cl.
USPC ..... 473/454; 473/422; 473/421

(58) Field of Classification Search
USPC ..... 473/421, 197, 432, 454–456, 468, 190
See application file for complete search history.

(56) References Cited

U.S. PATENT DOCUMENTS

| | | | | | |
|---|---|---|---|---|---|
| 1,540,670 | A | * | 6/1925 | Vidmer | 473/190 |
| 1,656,718 | A | | 1/1928 | Bickford | |
| 2,043,273 | A | | 6/1936 | Watson | |
| 2,931,373 | A | * | 4/1960 | Larson | 135/90 |
| 3,260,527 | A | * | 7/1966 | Younce | 473/166 |
| 3,593,997 | A | * | 7/1971 | Boehner | 473/421 |
| 3,980,304 | A | * | 9/1976 | O'Neill et al. | 473/421 |
| 4,657,250 | A | | 4/1987 | Newland et al. | |
| 4,733,865 | A | | 3/1988 | Reed | |
| 4,913,427 | A | | 4/1990 | Wilson | |
| 4,969,651 | A | * | 11/1990 | Comartin | 473/421 |
| 5,018,731 | A | | 5/1991 | Doyle | |
| 5,133,548 | A | | 7/1992 | Bedord, II et al. | |
| 5,271,616 | A | | 12/1993 | Grimaldi | |
| 5,419,549 | A | | 5/1995 | Galloway et al. | |
| 5,439,211 | A | | 8/1995 | Drabowsky | |
| 5,655,766 | A | | 8/1997 | Klebe, Jr. | |
| 5,672,125 | A | | 9/1997 | Ross | |
| 5,730,442 | A | * | 3/1998 | Anderson | 473/421 |
| 5,803,842 | A | | 9/1998 | Ross | |
| 5,823,885 | A | | 10/1998 | Stempfer | |
| 6,102,021 | A | | 8/2000 | Sanders et al. | |
| 6,485,373 | B1 | * | 11/2002 | Stephens | 473/197 |
| 6,494,224 | B2 | * | 12/2002 | Zheng | 135/125 |
| 6,729,981 | B1 | | 5/2004 | Clifton | |
| D612,002 | S | | 3/2010 | Richard | |
| 2002/0098920 | A1 | | 7/2002 | Bruyer et al. | |
| 2002/0123397 | A1 | | 9/2002 | Brasuell | |
| 2008/0248901 | A1 | | 10/2008 | Mosier et al. | |
| 2009/0286631 | A1 | | 11/2009 | Hammons et al. | |
| 2009/0298622 | A1 | | 12/2009 | Roberts | |
| 2012/0010028 | A1 | * | 1/2012 | Hammons | 473/454 |

FOREIGN PATENT DOCUMENTS

| | | |
|---|---|---|
| WO | WO95/34351 | 12/1995 |

* cited by examiner

*Primary Examiner* — Mitra Aryanpour
(74) *Attorney, Agent, or Firm* — George P. White

(57) ABSTRACT

A fabric tunnel for baseball pitching practice with a simple "auto-catcher" is made of netting in one embodiment. At the target end a flap with indicia of accuracy of aim also constitutes a flap that provides an audible feedback when hit and also allows the thrown balls to be captured. Straps are used to hold the tunnel in position by attachment to poles supported by guy wires or the straps could be attached to fixed objects such as a chain-link fence.

3 Claims, 6 Drawing Sheets

FIG. 1
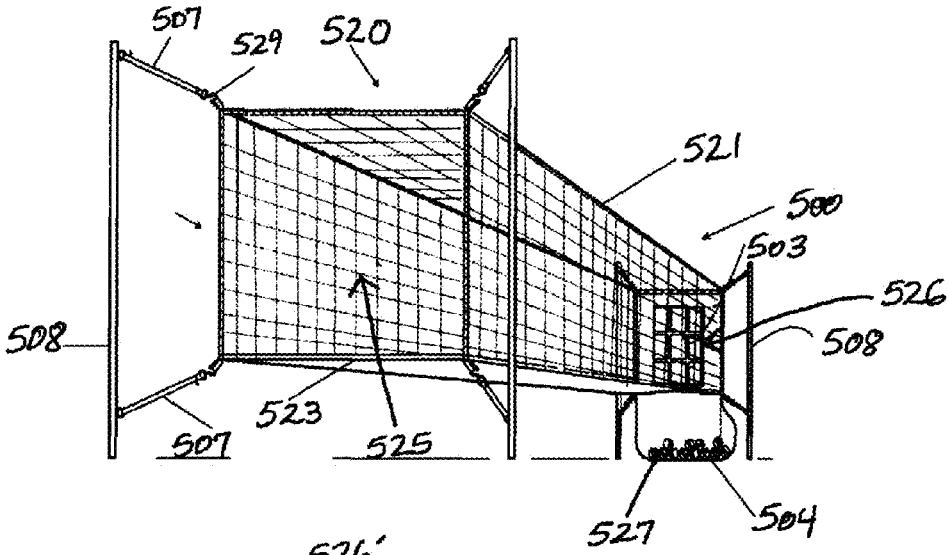
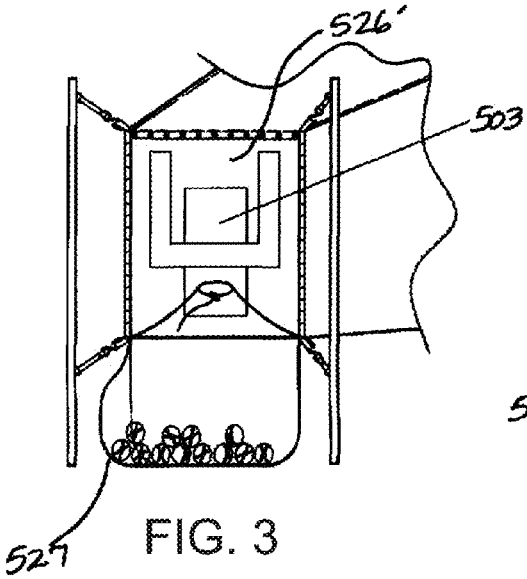
FIG. 3
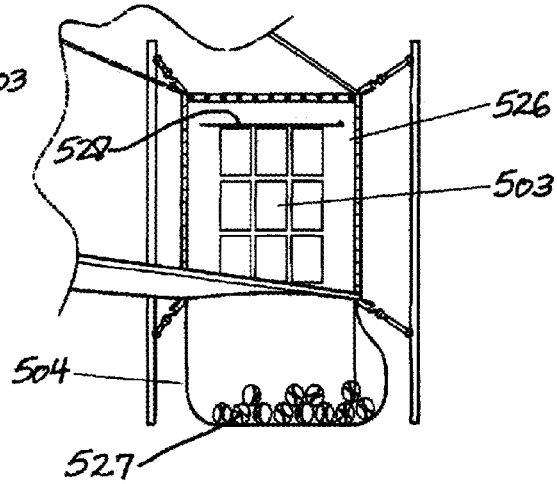
FIG. 2

LIGHTWEIGHT TUNNEL FOR BASEBALL PITCHING PRACTICE

RELATED APPLICATIONS

This application is a continuation application of PCT/US11/01199 filed Jul. 7, 2011 designating the U.S. which in turn claims the benefit of U.S. provisional application 61/362,047 filed Jul. 7, 2010. These two applications are hereby incorporated herein by reference in their entirety.

FIELD

These systems and methods are in the field of devices and techniques for practicing a game played with a ball.

BACKGROUND

While there are numerous fixed-location batting cages and some transportable batting cages, these devices generally provide no utility for the practice of pitching.

SUMMARY

Embodiments consistent with these teachings can include a tunnel made of netting with one open side. That open end can be of a size suitable for someone to stand in front of and pitch a ball through the tunnel towards the distal end. The distal end includes a target area of size and with indicia delineating an appropriate region for baseball strikes. A containing region within the distal end can provide for capture and retention of "caught" balls. Embodiments of these teachings do not require rigid frames along the length of the tunnel.

BRIEF DESCRIPTION OF THE DRAWINGS

FIG. 1 shows in perspective an example embodiment of the pitching practice "auto-catching" tunnel set up for use—note that in these figures the netting mesh is shown to be larger than would be effective to prevent a baseball's trajectory, this is for increased clarity in the figures.

FIG. 2 shows, in isolation, the target region of the apparatus of FIG. 1;

FIG. 3 shows an alternate target embodiment from a view similar to that of FIG. 2;

FIG. 10 shows an alternate manner of securing one end of a tunnel to a backstop or the like;

DETAILED DESCRIPTION

Figure 4:
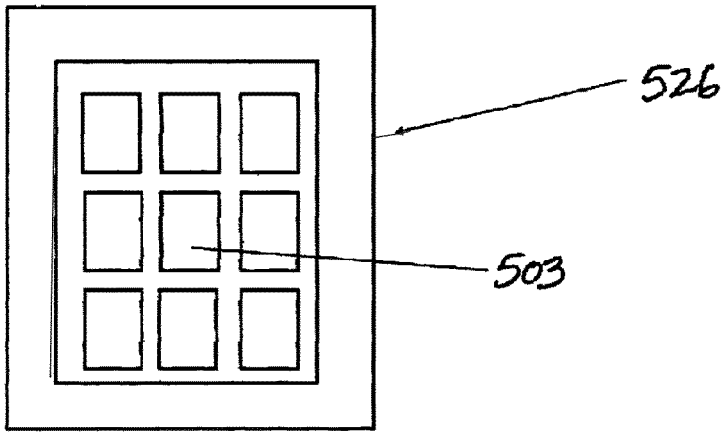
FIG. 4 shows a front view of a portion of the target of FIG. 2.

This is related to the present inventor's application published as US 2009/0286631 A1 on Nov. 19, 2009. Many of the options and alternatives of that application as well as its uses are applicable to the present invention as well. That application is contained within this application to provide additional context.

Embodiments of the present invention can be made by trapezoidal lengths of netting sewn together with nylon webbing. FIG. 1 shows a pitching tunnel 500 set up for use. It includes a top netting 520 a right-hand side netting 521 a left side netting 522 and a bottom fabric 523. At the inside of the distal end is a target area 526. One end is the open end 525. At the distal end the target area has a target flap 503 A thrown ball accumulation containing area 504 is of netting and holds the balls 527 that have hit the target's flap and have fallen downward.

The tunnel is held in use configuration by straps 507 attached by hooks 529. In some installations some straps may be attached to fixed structures such as a chain-link fence. As shown, the straps are attached to vertical polls 508 which can be held by guy wires (not shown) for support. Although somewhat obscured in this FIG. 1, a portion of the target area 526 is constituted as a hinged flap 503 such that a ball thrown with adequate force opens the flap and allows a thrown ball to land the ball container region 504.

FIG. 2 shows the target area 526 in isolation and without netting for greater clarity. FIG. 3 is an alternate target 526' having different indicia for assisting a pitcher in their aim and in detecting where a thrown ball 527 actually hit. The indicia are of a size and configuration as to provide a visual target for aiming and a visual indicator as to the terminus of a thrown ball's trajectory.

Figure 5:
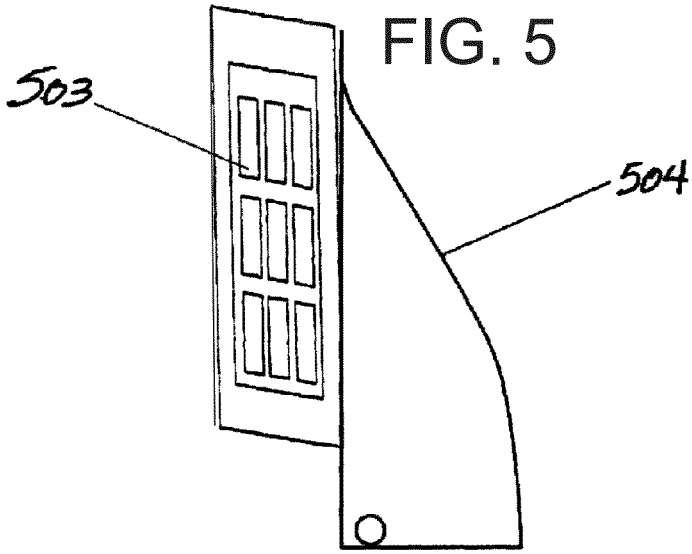
FIG. 5 shows a perspective front right side view of the target region of the apparatus of FIG. 1 including a container for caught balls.
Figure 6:
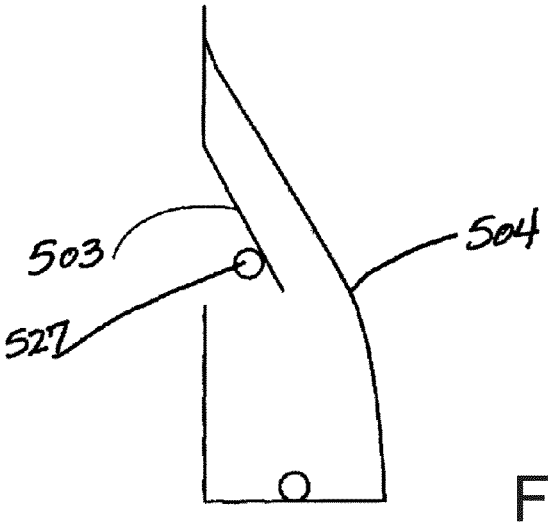
FIG. 6 shows a side view of the apparatus of FIG. 5.

In FIG. 2, a sub-region of the target area 526 is hinged at its top 528 as a flap and made of a material of sufficient rigidity that a ball thrown will make a sharp audible report, and deflect the flap allowing the ball to fall in the caught ball container 504. In FIG. 4 a view of just the target 526 of the apparatus of FIG. 1 is seen in a front view. A perspective view of the same portion of the apparatus is seen in FIG. 5, in this view, the ball accumulation area 504 is displayed. In the side view of FIG. 6 the flap 503 is shown in the open position due to a thrown ball 527 pushing it open.

Figure 7:
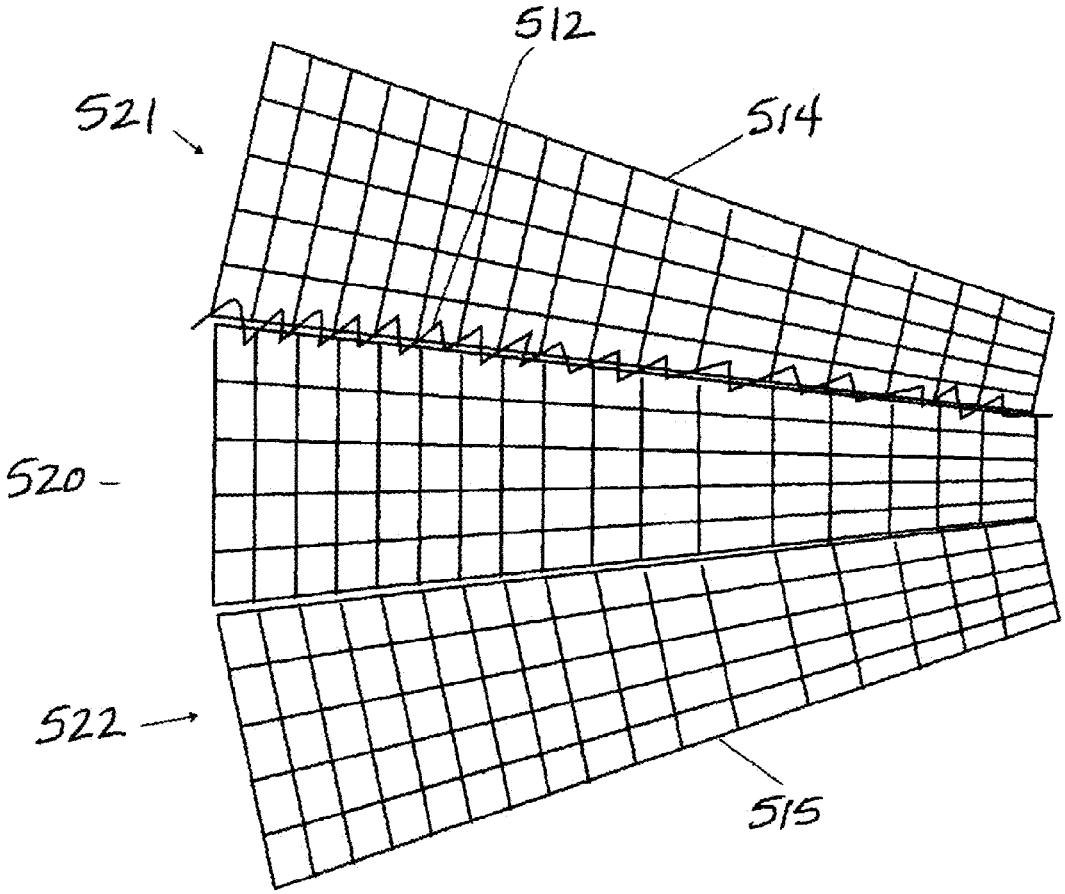
FIG. 7 shows a plan view of a top, right, and left sides of the tunnel of FIG. 1 laid out for assembly.
Figure 8:
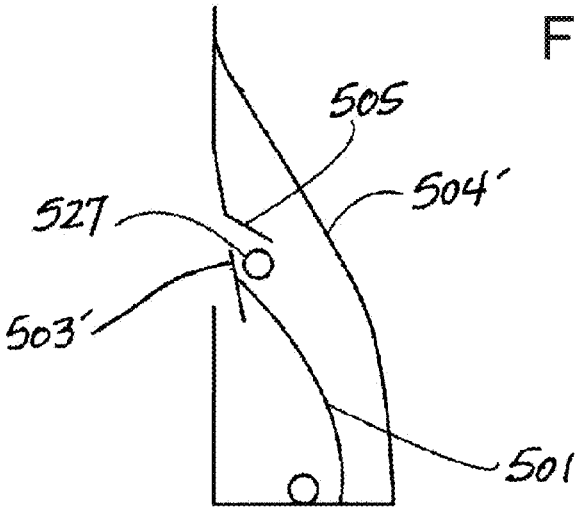
FIG. 8 shows a side view of an isolated target area of an alternate implementation.

There may be many materials and methods of construction compatible with these teachings. One manner of construction is demonstrated in FIG. 7 in a plan view. The trapezoidal sections nettings of the top 520 the right side 521 and the left side 522 are seen in a plan view. These sheets are laid out flat. In this configuration a nylon-webbing seam 512 can be woven in and out of the mesh of the netting creating a seam between the top and the right-hand side and a second steam between the top and the right side. Not shown is the bottom that could be similarly woven to the left side's lower edge of 515 and the right side lower edge 514. Alternatively, the bottom may be made of a fabric of other than netting and attached to the sides in a variety of manners known to those skilled in the art. Of course alternate materials might be used for the top and sides and ball containment area as well.

In FIG. 107 the caught ball region 504' of an alternate version is shown which has an "inner flap" 505 within a flap 503'. A ball 527 that hits the target in a particular location can deflect the inner flap 505 allowing that ball to fall into a distinct ball-collecting region 504' for more accurately thrown balls. Balls that do not hit the inner flap 505 end up in another ball-collecting region 501

Figure 9:
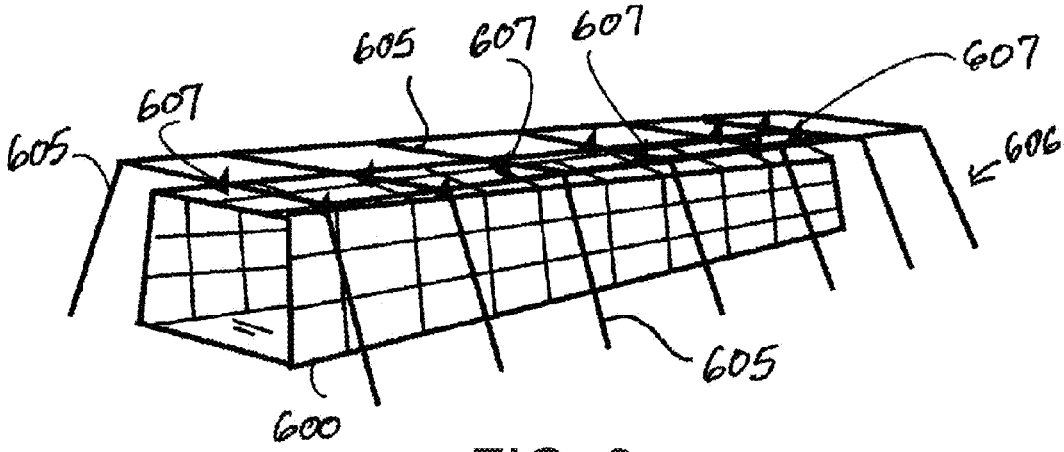
FIG. 9 shows a tunnel embodiment supported from the top by a modular framework.

FIG. 9 shows an alternate method of supporting a pitching tunnel 600. In this version the tunnel is held by ties 607 to the top rails of a modular framework 606 comprised of interconnected pipes 605.

Figure 10:
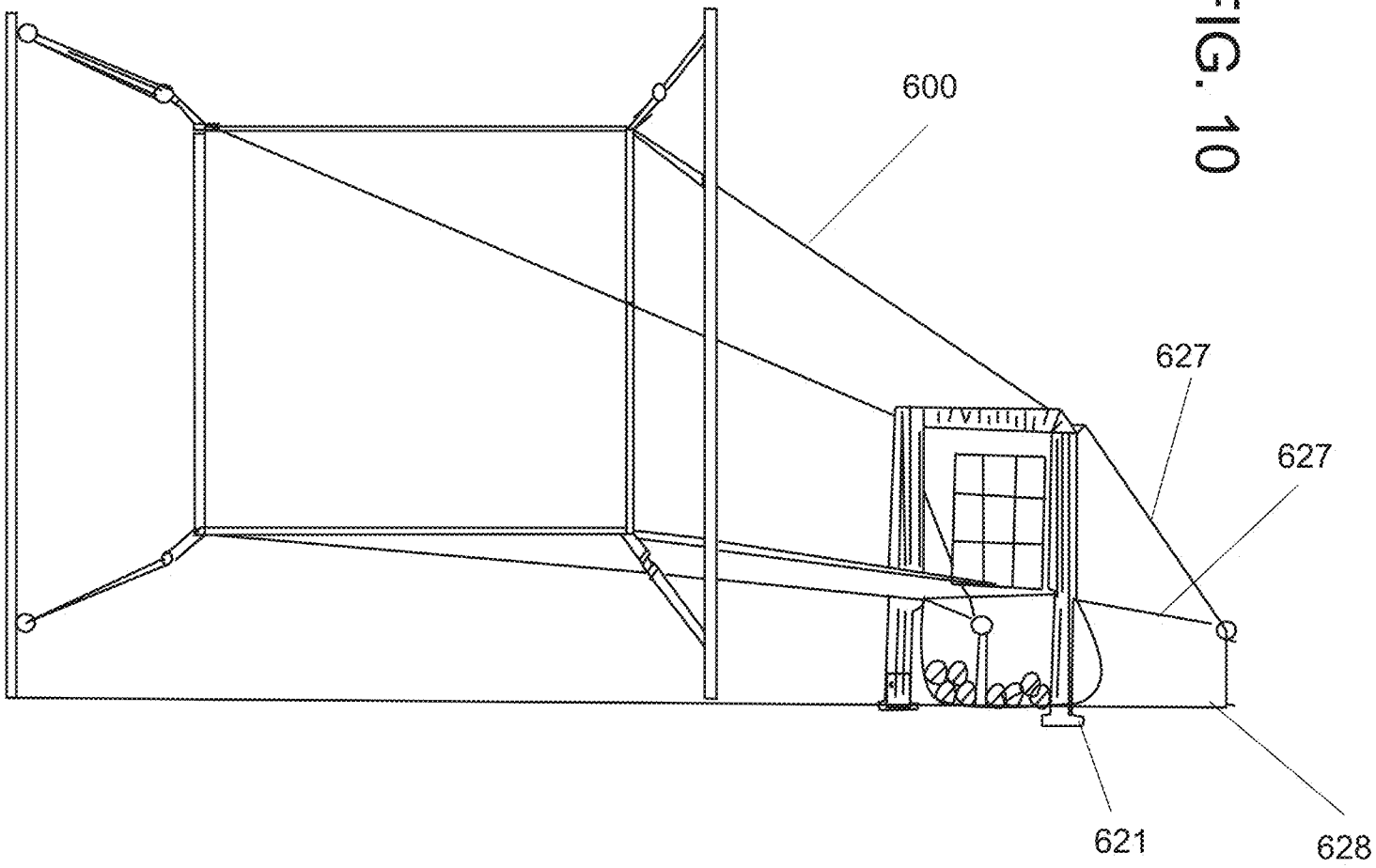

FIG. 10 shows and partially describes an alternate method of attaching the target area 626 of a tunnel to a backstop or the like. Shown in this figure is an outer sleeve 620 designed to hold metal legs 621. This design is useful because many baseball fields have a tall backstop on one end, and grass or dirt on the far end. If the user were to fasten the target end of the tunnel to a tall backstop, then one could slide the metal legs into the outer sleeve. The user could then secure the tunnel to ground stakes 628 using straps 627. The metal legs give the tunnel its shape in this case.

Figure 11:
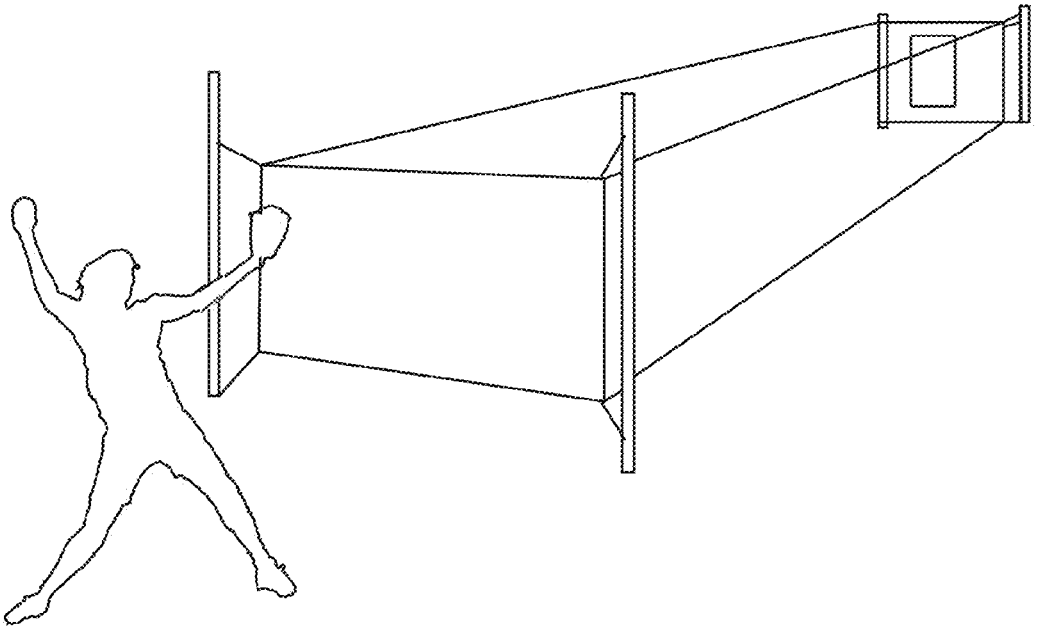
FIG. 11 shows a version for use for softball.

FIG. 11 shows a female using a version for use in softball. In this version and other versions the tautness of the support members can be achieved with hand winches.

Those skilled in the art will be aware of materials, techniques and equipment suitable to produce the example embodiments presented as well as variations on those examples. This teaching is presented for purposes of illustration and description but is not intended to be exhaustive or limiting to the forms disclosed. Many modifications and variations will be apparent to those of ordinary skill in the art. The embodiments and versions help to explain the principles of the invention, the practical application, and to enable others of ordinary skill in the art to understand it. Various embodiments with various modifications as are suited to the particular application contemplated are expected.

In the following claims, the words "a" and "an" should be taken to mean "at least one" in all cases, even if the wording "at least one" appears in one or more claims explicitly. The scope of the invention is set out in the claims below.

What is claimed:

1. A baseball pitching-practice tunnel comprising:

a four-sided fabric having a length approximately that of a distance between a pitching mound and a home plate in a baseball field, or a softball field;

each of said four fabric sides being planar and trapezoidal in shape, such as, when deployed, said four fabric sides define a tapering tunnel with an open front end and a narrower distal end;

wherein the opening of said front end is of a size large enough so a player standing at the front end opening can safely throw balls into the tunnel without significant risk of missing the front end opening;

said distal end comprising a target area, said target area including a target flap hingedly disposed within the target area, the tunnel further including a region behind said flap for capturing thrown balls, said region being readily accessible to extract thrown balls, said flap providing an audible feedback when hit by a thrown ball;

still further, the tunnel comprising attachment points at said open front end and said distal end for deploying the tunnel tautly, the attachment points having a strength sufficient to allow support of the tunnel when stretched to the extent that the tunnel is fully deployed and taut, and whereby the tunnel requires no rigid frames along the length of the tunnel, and wherein the fabric on at least one of the four-sides of the tunnel is formed of a net material.

2. The pitching practice tunnel of claim 1, wherein said attachment points at the distal end of the tunnel comprise at least four straps, at least one strap attached to each distal end corner, said at least four straps terminating in hooks and suitable for connecting to a backstop or chain link fence, and wherein at least three of the four-sided fabric comprise a net material.

3. The pitching practice tunnel of claim 1 further comprising at the distal end of the tunnel, a demarcated target region having at least two distinctly demarcated portions.

* * * * *